US008491108B2

(12) United States Patent
Kuribayashi et al.

(10) Patent No.: US 8,491,108 B2
(45) Date of Patent: Jul. 23, 2013

(54) INK JET RECORDING APPARATUS

(75) Inventors: Yasushi Kuribayashi, Shizuoka-ken (JP); Masashi Hiroki, Kanagawa-ken (JP); Satoshi Kaiho, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 412 days.

(21) Appl. No.: 12/969,750

(22) Filed: Dec. 16, 2010

(65) Prior Publication Data

US 2011/0148997 A1 Jun. 23, 2011

Related U.S. Application Data

(60) Provisional application No. 61/288,641, filed on Dec. 21, 2009.

(51) Int. Cl.
*B41J 2/175* (2006.01)
*B41J 2/17* (2006.01)

(52) U.S. Cl.
USPC ..... 347/85; 347/84

(58) Field of Classification Search
USPC ..... 347/84, 85
See application file for complete search history.

(56) References Cited

U.S. PATENT DOCUMENTS 6,932,462 B2 * 8/2005 Watanabe ..... 347/65
2007/0252860 A1 11/2007 Nitta et al.
2010/0302324 A1 * 12/2010 Grossrubatscher ..... 347/85

* cited by examiner

*Primary Examiner* — Jannelle M LeBron
(74) *Attorney, Agent, or Firm* — Turocy & Watson, LLP

(57) ABSTRACT

According to one embodiment, an inkjet recording apparatus includes a plurality of inkjet heads, a common supply pipe, a common collection pipe and an ink tank device. The common supply pipe includes an upper inner wall from one end side in a longitudinal direction to the other end side, which is inclined with respect to a horizontal direction from the one end side to the other end side if an ink flow direction and opposite direction of a gravitational force are defines as positive axes. The common collection pipe is supplied with the ink from the common supply pipe at one end side in the longitudinal direction. The ink tank device supplies the ink to the one end side of the common supply pipe, and collects the ink from the common collection pipe.

19 Claims, 4 Drawing Sheets

INK JET RECORDING APPARATUS

CROSS-REFERENCE TO RELATED APPLICATIONS

This application is based upon and claims the benefit of priority from Provisional Application No. 61/288,641, filed on Dec. 21, 2009; the entire contents of which are incorporated herein by reference.

FIELD

Embodiments described herein relate generally to an inkjet recording apparatus in which ink is circulated through inkjet heads and the ink is ejected from nozzles of the inkjet heads.

BACKGROUND

Hitherto, an inkjet recording apparatus is known in which ink is circulated through inkjet heads and the ink is ejected from nozzles of the inkjet heads. In the inkjet recording apparatus as stated above, the ink is supplied to the inkjet heads and the ink is collected from the inkjet heads through two pipes branching from a circulation path for circulating the ink.

Air bubbles and foreign matters staying in the nozzles of the inkjet head flow from the inkjet heads to the circulation path by the circulating ink. If the air bubbles in the inside of the circulation path flow into the inkjet heads, a bad influence is exerted on a print operation.

The air bubbles in the inside of the circulation path can be eliminated only by the flow of the ink in the inside of the circulation path. However, if the flow path cross-sectional area of the circulation path is increased in order to decrease the flow path resistance of the circulation path, the flow speed of ink in the inside of the circulation path becomes low. Thus, elimination of the air bubbles in the inside of the circulation path is difficult.

DETAILED DESCRIPTION

In general, according to one embodiment, an inkjet recording apparatus includes a plurality of inkjet heads, a common supply pipe, a common collection pipe and an ink tank device. The common supply pipe is connected to a plurality of head supply pipes to supply ink to the plurality of inkjet heads, and includes an upper inner wall from one end side in a longitudinal direction to the other end side, which is inclined with respect to a horizontal direction from the one end side to the other end side if an ink flow direction and opposite direction of a gravitational force are defines as positive axes. The common collection pipe is supplied with the ink from the common supply pipe at one end side in the longitudinal direction, and includes a plurality of head collection pipes to collect the ink from the plurality of inkjet heads. The ink tank device supplies the ink to the one end side of the common supply pipe, and collects the ink from the common collection pipe.

Figure 1:
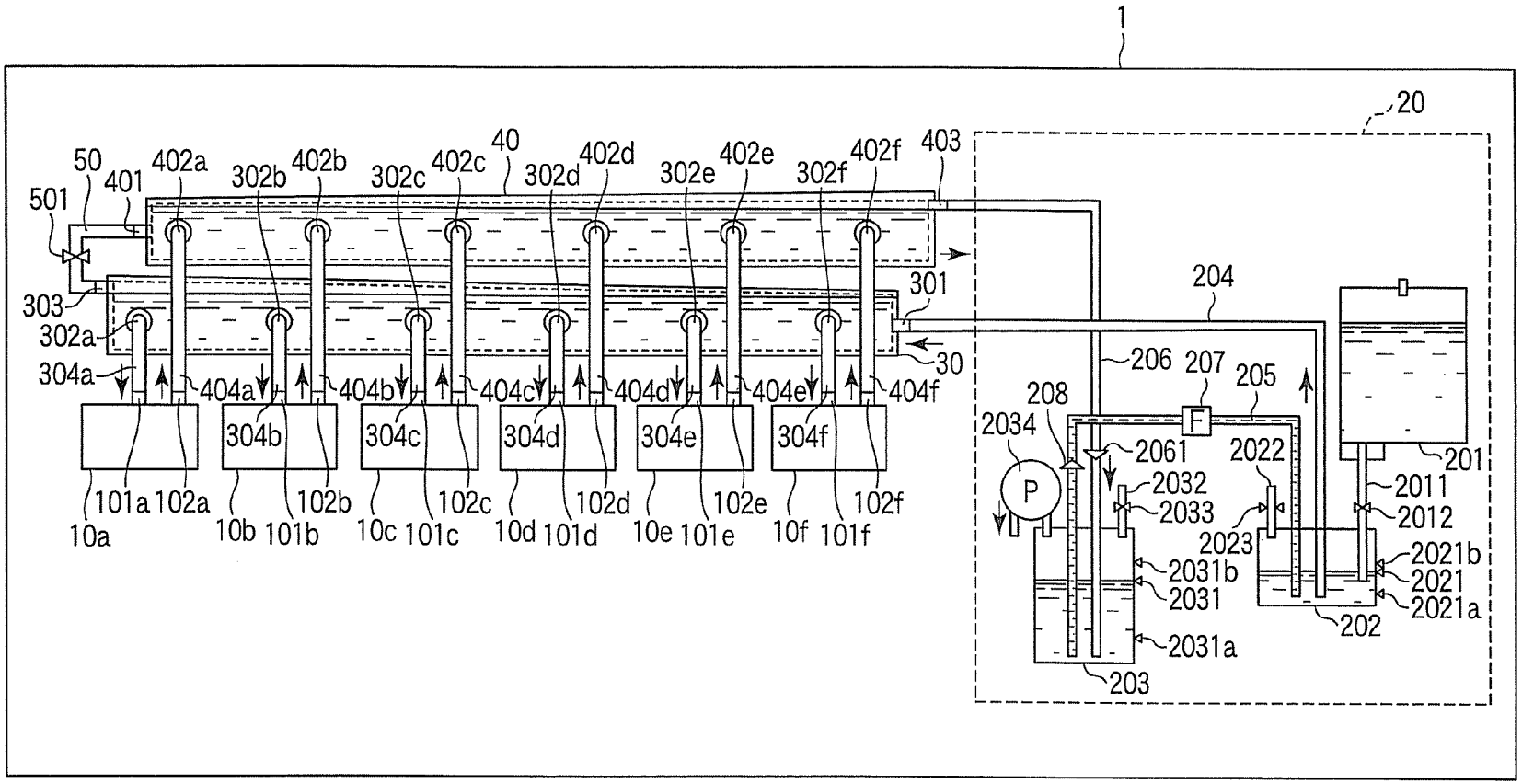
FIG. 1 is a front view for explaining an outline of an inkjet recording apparatus of an embodiment.

Hereinafter, embodiments will be described with reference to the drawings. FIG. 1 is a front view for explaining an outline of an inkjet recording apparatus 1 of an embodiment. The inkjet recording apparatus 1 includes a plurality (six in FIG. 1) of inkjet heads 10*a*, 10*b*, 10*c*, 10*d*, 10*e* and 10*f*, an ink tank device 20, a common supply pipe 30, a common collection pipe 40 and a connection pipe 50.

First, the structure of the inkjet heads 10*a* to 10*f* will be described. The inkjet heads 10*a* to 10*f* are arranged at the same height and almost horizontally. The inkjet heads 10*a* to 10*f* are of ink circulation type. The inkjet head 10*a* includes a supply port 101*a* and a discharge port 102*a*. The inkjet head 10*b* includes a supply port 101*b* and a discharge port 102*b*. The inkjet head 10*c* includes a supply port 101*c* and a discharge port 102*c*. The inkjet head 10*d* includes a supply port 101*d* and a discharge port 102*d*. The inkjet head 10*e* includes a supply port 101*e* and a discharge port 102*e*. The inkjet head 10*f* includes a supply port 101*f* and a discharge port 102*f*.

Figure 2:
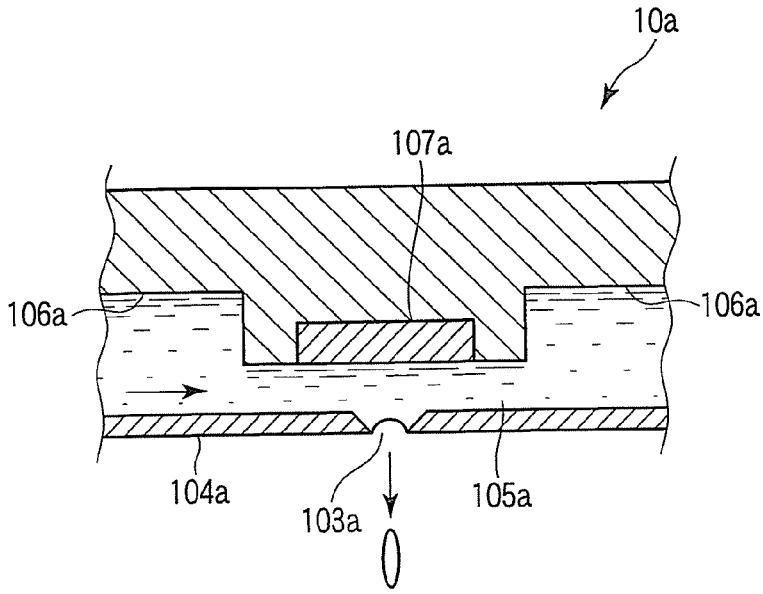
FIG. 2 is an exemplary lateral direction sectional view showing a structure of an inkjet head of the embodiment.

Here, the structure of the inkjet head 10*a* will be described. FIG. 2 is a lateral direction sectional view showing the structure of the inkjet head 10*a*. In the inkjet head 10*a*, a pressure chamber 105*a* is formed on an upper surface side of an orifice plate 104*a* provided with a nozzle 103*a*. Ink flowing into the inkjet head 10*a* from the supply port 101*a* shown in FIG. 1 circulates from the left to the right via the pressure chamber 105*a* as indicated by an arrow in FIG. 2. The pressure chamber 105*a* is narrower than the circulation path 106*a*. The pressure chamber 105*a* includes an actuator 107*a* at an opposite surface side to the nozzle 103*a*. The pressure chamber 105*a* ejects an ink droplet from the nozzle 103*a* by driving the actuator 107*a*. Although the actuator 107*a* is, for example, a piezoelectric element, the structure is not limited. Incidentally, since the inkjet heads 10*b* to 10*f* have the same structure as the inkjet head 10*a*, their illustration and explanation is omitted.

Next, the structure of the ink tank device 20 will be described. The ink tank device 20 includes a main tank 201, an upstream side tank 202 and a downstream side tank 203. The main tank 201 stores ink. The main tank 201 is opened to the atmospheric pressure. The main tank 201 includes a pipe 2011 to supply the ink to the upstream side tank 202. The pipe 2011 includes a valve 2012. The ink in the main tank 201 flows to the upstream side tank 202 when the valve 2012 is open.

Next, the structure of the upstream side tank 202 will be described. The upstream side tank 202 contains the ink before supply to the inkjet heads 10*a* to 10*f*. The upstream side tank 202 is an airtight container. The upstream side tank 202 includes a liquid surface sensor 2021, a pipe 2022 and a valve 2023. The liquid surface sensor 2021 detects the position of the liquid surface of ink from the bottom of the upstream side tank 202. A position 2021*a* indicates a lower limit of ink contained in the upstream side tank 202, and the ink tank device 20 normally operates if the ink is positioned above the lower limit. A position 2021*b* indicates an upper limit of the ink contained in the upstream side tank 202, and the ink tank device 20 normally operates if the ink is positioned below the upper limit. If detecting a position outside the range of from the position 2021*a* to the position 2021*b*, the liquid surface sensor 2021 notifies to that effect. The pipe 2022 causes the inside of the upstream side tank 202 to communicate with the atmosphere. The valve 2023 is provided in the pipe 2022. If the valve 2023 is open, the inside of the upstream side tank 202 communicates with the atmosphere.

Besides, the ink tank device 20 includes a pipe 204 for supplying the ink contained in the upstream side tank 202 to the common supply pipe 30. A port of the pipe 204 at one end side is provided to be spaced from the bottom of the upstream side tank 202 by a specified distance. The other end side of the pipe 204 is connected to the common supply pipe 30. Further, the ink tank device 20 includes a pipe 205 for flowing the ink contained in the downstream side tank 203 to the upstream side tank 202. A port of the pipe 205 at one end side is provided to be spaced from the bottom of the upstream side tank 202 by a specified distance.

Next, the structure of the downstream side tank 203 will be described. The downstream side tank 203 contains ink after circulation through the inside of the inkjet heads 10*a* to 10*f*. The downstream side tank 203 is an airtight container. The downstream side tank 203 includes a liquid surface sensor 2031, a pipe 2032, a valve 2033 and a pump 2034. The liquid surface sensor 2031 detects a position of the liquid surface of the ink from the bottom of the downstream side tank 203. A position 2031*a* indicates a lower limit of the ink contained in the downstream side tank 203, and the ink tank device 20 normally operates if the ink is positioned above the lower limit. A position 2031*b* indicates an upper limit of the ink contained in the downstream side tank 203, and the ink tank device 20 normally operates if the ink is positioned below the upper limit. If detecting a position outside the range of from the position 2031*a* to the position 2031*b*, the liquid surface sensor 2031 notifies to that effect. The pipe 2032 causes the inside of the downstream side tank 203 to communicate with the atmosphere. The valve 2033 is provided in the pipe 2032. When the valve 2033 is open, the inside of the downstream side tank 203 communicates with the atmosphere. The pump 2034 sucks the air in the inside of the downstream side tank 203. The pump 2034 generates a negative pressure in the inside of the downstream side tank 203 by its operation.

Besides, the ink tank device 20 includes a pipe 206 for introducing the ink flowing out from the common collection pipe 40 into the downstream side tank 203. A port of the pipe 206 at one end side is provided to be spaced from the bottom of the downstream side tank 203 by a specified distance. The other end side of the pipe 206 is connected to the common collection pipe 40. The pipe 206 includes a backflow prevention valve 2061. The backflow prevention valve 2061 prevents the backflow of ink from the downstream side tank 203 to the common collection pipe 40. Further, a port of the pipe 205 at the other end side is provided to be spaced from the bottom of the upstream side tank 202 by a specified distance. Accordingly, the ink contained in the downstream side tank 203 flows to the upstream side tank 202 through the pipe 205. The pipe 205 includes a filter 207 and a backflow prevention valve 208. The filter 207 removes foreign matters included in the ink. The backflow prevention valve 208 prevents the backflow of ink from the upstream side tank 202 to the downstream side tank 203.

Next, the structure of the common supply pipe 30 will be described. The common supply pipe 30 includes a supply port 301, branch ports 302*a*, 302*b*, 302*c*, 302*d*, 302*e* and 302*f*, and a discharge port 303. The supply port 301 is provided in the surface of the common supply pipe 30 at one end side (first end side) along the longitudinal direction. One end of the supply port 301 is connected to the ink tank device 20, and the other end is connected to the pipe 204. The respective branch ports 302*a* to 302*f* are provided at regular intervals along the longitudinal direction of the common supply pipe 30 and in descending order of distance from the first end side. The branch ports 302*a* to 302*f* are provided at the middle points of the common supply pipe 30 in the height direction. The branch ports 302*a* to 302*f* are respectively connected to head supply pipes 304*a* to 304*f*.

The head supply pipe 304*a* is connected to the supply port 101*a* provided in the inkjet head 10*a*. Similarly, the head supply pipe 304*b* is connected to the supply port 101*b* provided in the inkjet head 10*b*. The head supply pipe 304*c* is connected to the supply port 101*c* provided in the inkjet head 10*c*. The head supply port 304*d* is connected to the supply port 101*d* provided in the inkjet head 10*d*. The head supply pipe 304*e* is connected to the supply port 101*e* provided in the inkjet head 10*e*. The head supply pipe 304*f* is connected to the supply port 101*f* provided in inkjet head 10*f*. The ink in the inside of the common supply pipe 30 branches and flows to the head supply pipes 304*a* to 304*f*. The discharge port 303 is arranged at a position higher than the supply port 301. The discharge port 303 is provided in the surface of the common supply pipe 30 at the other end side (second end side) along the longitudinal direction. The discharge port 303 is connected to the connection pipe 50.

Incidentally, the flow path cross-sectional areas of the common supply pipe 30 at positions of the branch ports 302*a* to 302*f* are respectively four or more times larger than the flow path cross-sectional areas of the head supply pipes 304*a* to 304*f*. Accordingly, if the inside of the common supply pipe 30 is filled with ink, a difference between flow path resistances at the respective positions of the branch ports 302*a* to 302*f* of the common supply pipe 30 is sufficiently reduced as compared with the case where the flow path cross-sectional areas of the common supply pipe 30 at the positions of the branch ports 302*a* to 302*f* are respectively equal to the flow path cross-sectional areas of the head supply pipes 304*a* to 304*f*. Since a difference between pressures applied to the inkjet heads 101*a* to 101*f* is also reduced, the pressure in the vicinity of the nozzle of each of the inkjet heads 10*a* to 10*f* is kept at the optimum pressure for ink ejection. As a result, in the inside of each of the inkjet heads 10*a* to 10*f*, the circulation amount of ink sufficient to eliminate air bubbles and foreign matters can be ensured.

Figure 3:
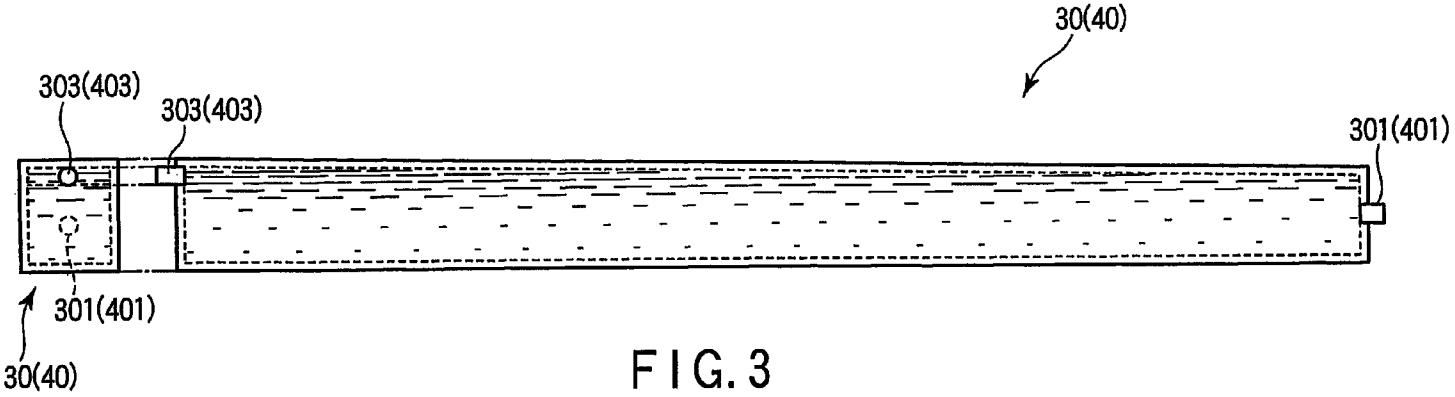
FIG. 3 is an exemplary view showing a common supply pipe and a common collection pipe of the embodiment.

Next, the shape of the common supply pipe 30 will be described. The common supply pipe 30 is provided in the inkjet recording apparatus 1 such that an upper inner wall has a positive inclination from the first end side to the second end side with respect to the horizontal direction when an ink flowing direction and an opposite direction of a gravitational force are detuned as positive axes direction. FIG. 3 is a flow path sectional view of the common supply pipe 30 at the second end side and is a sectional view in the longitudinal direction. The common supply pipe 30 is formed so that a flow path cross section is rectangular, and a flow path cross-sectional area becomes large from the first end side to the second end side. The lower inner wall of the common supply pipe 30 is horizontal. The upper inner wall of the common supply pipe 30 has a linear positive inclination from the first end side to the second end side with respect to the horizontal direction. The upper surface of the discharge port 303 is provided at the second end side of the common supply pipe 30 and in the vicinity of the upper inner wall of the common supply pipe 30 (so as to contact with, for example, the upper inner wall of the common supply pipe 30).

Incidentally, the common supply pipe 30 may be formed so that the flow path cross section is circular, and the flow path cross-sectional area becomes large from the first end side to the second end side. Also in this case, the upper inner wall of the common supply pipe 30 in the longitudinal direction has the linear positive inclination with respect to the horizontal direction from the first end side to the second end side. Incidentally, the upper inner wall of the common supply pipe 30 in the longitudinal direction may not have the linear positive inclination from the first end side to the second end side with respective to the horizontal direction, but has only to have such a shape that in a state where ink is filled in the inside of the common supply pipe 30, the air flows from the first end side to the second end side without staying in the inside of the common supply pipe 30. For example, the upper inner wall of the common supply pipe 30 may have a positive curved line from the first end side to the second end side with respect to the horizontal direction. The discharge port 303 may not be arranged in the vicinity of the upper inner wall of the common supply pipe 30, but may be arranged at an arbitrary position higher than the center in the height direction.

Next, the structure of the common collection pipe 40 will be described. The common collection pipe 40 is arranged above the common supply pipe 30 in the vertical direction. The common collection pipe 40 includes a supply port 401, joining ports 402*a*, 402*b*, 402*c*, 402*d*, 402*e* and 402*f*, and a discharge port 403. The supply port 401 is provided in a surface of the common collection pipe 40 at one end side (first end side) along the longitudinal direction. The supply port 401 is connected to the other end of the connection pipe 50 one end of which is connected to the common supply pipe 30. The connection pipe 50 includes a valve 501. When the valve 501 is open, the common supply pipe 30 communicates with the common collection pipe 40 through the connection pipe 50. The supply port 401 of the common collection pipe 40 is provided above the discharge port 303 of the common supply pipe 30. The respective joining ports 402*a* to 402*f* are provided in the common collection pipe 40 at regular intervals in the longitudinal direction of the common collection pipe 40 in ascending order of distance from the first end side. The joining ports 402*a* to 402*f* are provided at middle points of the common collection pipe 40 in the height direction. The joining ports 402*a* to 402*f* are respectively connected to head collection pipes 404*a* to 404*f*.

The head collection pipe 404*a* is connected to the discharge port 102*a* provided in the inkjet head 10*a*. Similarly, the head collection pipe 404*b* is connected to the discharge port 102*b* provided in the inkjet head 10*b*. The head collection pipe 404*c* is connected to the discharge port 102*c* provided in the inkjet head 10*c*. The head collection pipe 404*d* is connected to the discharge port 102*d* provided in the inkjet head 10*d*. The head collection pipe 404*e* is connected to the discharge port 102*e* provided in the inkjet head 10*e*. The head collection pipe 404*f* is connected to the discharge port 102*f* provided in the inkjet head 10*f*. The ink circulating through the inside of the inkjet head 101*a* joins the inside of the common collection pipe 40 through the head collection pipe 404*a*. The same applies to the ink circulating through the insides of the inkjet heads 101*b* to 101*f*. The discharge port 403 is provided in the surface of the common collection pipe 40 at the other end side (second end side) in the longitudinal direction. The discharge port 403 is arranged above the supply port 401. The discharge port 403 is connected to the pipe 206.

Incidentally, the flow path cross-sectional areas of the common collection pipe 40 at positions of the joining ports 402*a* to 402*f* are respectively four or more times larger than the flow path cross-sectional areas of the head collection pipes 404*a* to 404*f*. Accordingly, if the inside of the common collection pipe 40 is filled with ink, a difference between flow path resistances at the respective positions of the joining ports 402*a* to 402*f* of the common collection pipe 40 is sufficiently reduced as compared with the case where the flow path cross-sectional areas of the common collection pipe 40 at the positions of the joining ports 402*a* to 402*f* are respectively equal to the flow path cross-sectional areas of the head collection pipes 404*a* to 404*f*.

Next, the shape of the common collection pipe 40 will be described. The common collection pipe 40 is provided in the inkjet recording apparatus 1 such that an upper inner wall has the positive inclination from the first end side to the second end side with respect to the horizontal direction. The common supply pipe 30 is provided in the inkjet recording apparatus 1 such that an upper inner wall has a positive inclination from the first end side to the second end side with respect to the horizontal direction when an ink flowing direction and an opposite direction of a gravitational force are detuned as positive axes direction. FIG. 3 is also a flow path sectional view of the common collection pipe 40 at the second end side and a sectional view in the longitudinal direction. The common collection pipe 40 has the same shape as the common supply pipe 30. The common collection pipe 40 is formed so that the flow path cross section is rectangular and the flow path cross-sectional area becomes large from the first end side to the second end side. The lower inner wall of the common collection pipe 40 is horizontal. The upper inner wall of the common collection pipe 40 has a linear positive inclination from the first end side to the second end side with respect to the horizontal direction. The upper surface of the discharge port 403 is provided at the second end side of the common collection pipe 40 and in the vicinity of the upper inner wall of the common collection pipe 40 (so as to contact with, for example, the upper inner wall of the common collection pipe 40).

Incidentally, the common collection pipe 40 may be formed such that the flow path cross section is circular and the flow path cross-sectional area becomes large from the first end side to the second end side. The upper inner wall of the common collection pipe 40 may not have the linear positive inclination from the first end side to the second end side with respect to the horizontal direction, but has only to have such a shape that in a state where ink is filled in the inside of the common collection pipe 40, the air flows from the first end side to the second end side without staying in the inside of the common collection pipe 40.

Next, the filling of ink into the common supply pipe 30 and the common collection pipe 40 will be described. At the initial stage, the common supply pipe 30 and the common collection pipe 40 are filled with air. At the time of the filling of ink, the valve 501 of the connection pipe 50 is open. In the ink tank device 20, the valve 2023 of the upstream side tank 202 is open. The valve 2033 of the downstream side tank 203 is closed. In this state, ink is supplied to the upstream side tank 202 from the main tank 201 and is supplied until the liquid surface sensor 2021 detects the position 2021*b*. The user drives the pump 2034.

If the pump 2034 sucks the air in the inside of the downstream side tank 203, the ink in the inside of the upstream side tank 202 flows to the common supply pipe 30 through the pipe 204. The ink flowing into the inside of the common supply pipe 30 stays in the inside of the common supply pipe 30, and flows to the inkjet heads 10*a* to 10*f* through the head supply pipes 304*a* to 304*f*. Further, the ink in the inside of the common supply pipe 30 flows to the common collection pipe 40 through the connection pipe 50. The ink flowing into the inkjet heads 10*a* to 10*f* circulates through the inside of these, and then flows to the common collection pipe 40 through the head collection pipes 404*a* to 404*f*. That is, in the inside of the common collection pipe 40, the ink flowing from the connection pipe 50 joins the ink flowing from the inkjet heads 10*a* to

10*f*. The ink in the inside of the common collection pipe 40 flows to the downstream side tank 203 through the pipe 206. The ink in the inside of the downstream side tank 203 flows to the upstream side tank 202 through the pipe 205.

As the amount of ink in the inside of the common supply pipe 30 increases, the air in the inside of the common supply pipe 30 moves from the first end side to the second end side along the upper inner wall, and moves to the common collection pipe 40 through the connection pipe 50. As the amount of ink in the inside of the common collection pipe 40 increases, the air in the inside of the common collection pipe 40 also moves from the first end side to the second end side along the upper inner wall, and is discharged to the downstream side tank 203. As described above, the ink in the ink tank device 20 can be filled in the common supply pipe 30 and the common collection pipe 40. That is, when the filling of ink into the inside of the common supply pipe 30 and the common collection pipe 40 is completed, the air does not stay in the inside of the common supply pipe 30 and the common collection pipe 40. Accordingly, since the air does not enter the inkjet heads 10*a* to 10*f*, a bad influence is not exerted on the image formation using the inkjet heads 10*a* to 10*f*.

Incidentally, the user may open the valve 501 periodically in addition to the time of the filling of ink. For example, if air bubbles stay in the common supply pipe 30 by some reason, the user can open the valve 501 to discharge the air bubbles. By doing so, the air bubbles in the inside of the common supply pipe 30 are discharged to the ink tank device 20 through the connection pipe 50 and the common collection pipe 40 by the flow of the ink.

In the embodiment, it is desirable to satisfy the following condition. The flow path resistance of the connection pipe 50 is R, the number of inkjet heads is n, and the flow path resistances from the branch ports corresponding to the respective inkjet heads to the joining ports are R1 to Rn. If the value of R is set to satisfy $1/R>1/R1+1/R2+\ldots+1/Rn$, the flow amount of ink flowing through the connection pipe 50 becomes maximum while the valve 501 is open. In the inkjet recording apparatus 1, the air in the inside of the common supply pipe 30 can be efficiently made to flow. Further, if the value of R is set to satisfy $1/R>>1/R1+1/R2+\ldots+1/Rn$, the ink in the inside of the common supply pipe 30 hardly flows to the inkjet heads 10*a* to 10*f* while the valve 501 is open. Accordingly, in the inkjet recording apparatus 1, the air in the inside of the common supply pipe 30 can be efficiently made to flow, and the ink can be efficiently filled in the inside of the common supply pipe 30 and the common collection pipe 40.

Next, a description will be made on the ink circulation operation of the ink tank device 20 in the state where ink is filled in the common supply pipe 30 and the common collection pipe 40 (state where the air is eliminated). At the time of ink circulation, the valve 501 of the connection pipe 50 is closed. In the ink tank device 20, the valve 2023 of the upstream side tank 202 is open. The valve 2033 of the downstream side tank 203 is closed. Besides, the liquid surface sensor 2021 of the upstream side tank 202 detects the position 2021*b*, and the liquid surface sensor 2031 of the downstream side tank 203 detects the position 2031*a*. In this state, the user drives the pump 2034. If the pump 2034 sucks the air in the inside of the downstream side tank 203, the ink in the inside of the upstream side tank 202 flows to the common supply pipe 30 through the pipe 204. Since the valve 501 of the connection pipe 50 is closed, the ink in the inside of the common supply pipe 30 flows to the inkjet heads 10*a* to 10*f* through the head supply pipes 304*a* to 304*f*. The ink circulating through the inside of the inkjet heads 10*a* to 10*f* flows to the common collection pipe 40 through the head collection pipes 404*a* to 404*e*. The ink in the inside of the common collection pipe 40 flows to the downstream side tank 203 through the pipe 206. This operation continues until the sensor 2021 detects the position 2021*a* or the sensor 2031 detects the position 2031*b*. Thereafter, the operation of returning the ink to the upstream side tank is performed by the downstream side tank. If the pump 2034 sends air to the downstream side tank from the outside air, the ink in the inside of the downstream side tank 203 flows to the upstream side tank 202 through the pipe 205. This operation continues until the sensor 2021 detects the position 2021*b*, or the sensor 2031 detects the position 2031*b*. As described above, the ink tank device 20 can circulate the ink in the inside of the respective inkjet heads 10*a* to 10*f*.

Figure 4:
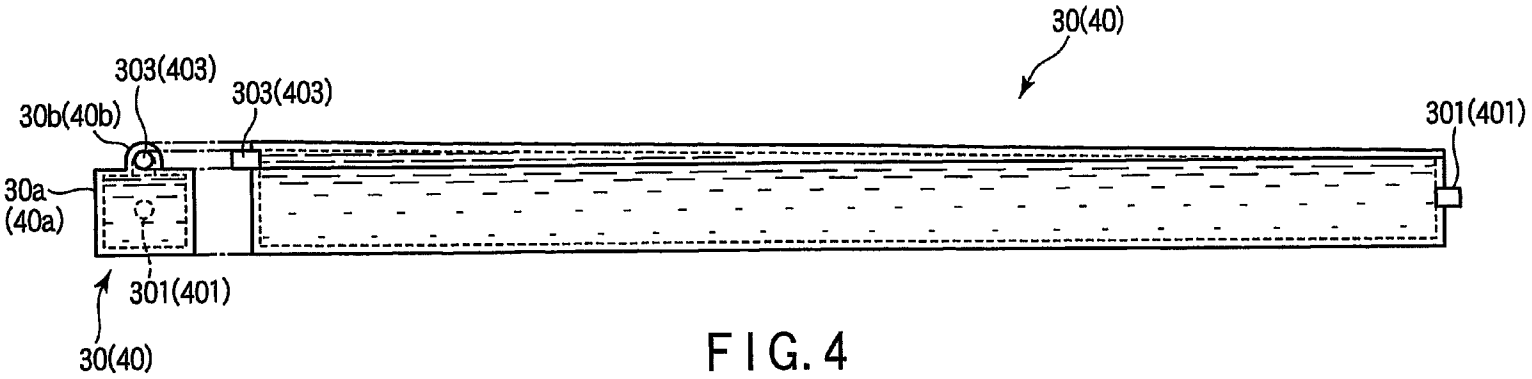
FIG. 4 is an exemplary view showing the common supply pipe and the common collection pipe of the embodiment.

FIG. 4 is a flow path sectional view of another example of the common supply pipe 30 at the second end side and is a sectional view in the longitudinal direction. Incidentally, FIG. 4 is also a flow path sectional view of another example of the common collection pipe 40 at the second end side and is a sectional view in the longitudinal direction. The common supply pipe 30 includes a tubular part 30*a* and an inclined part 30*b*. The inside of the tubular part 30*a* communicates with the inside of the inclined part 30*b*. In the tubular part 30*a*, a lower inner wall and an upper inner wall are horizontal. The inclined part 30*b* is provided at an upper part of the tubular part 30*a* and at the center in the width direction. The size of the inclined part 30*b* in the width direction is small as compared with the size of the tubular part 30*a* in the width direction. The flow path cross section of the inclined part 30*a* is semicircular. The inclined part 30*b* has a linear positive inclination from the first end side to the second end side with respect to the horizontal direction. Accordingly, the flow path cross-sectional area of the inclined part 30*b* becomes large from the first end side to the second end side. The upper surface of a discharge port 303 is provided at the second end side of the common supply pipe 30 and in the vicinity of the inner wall of the inclined part 30*b* (so as to contact with, for example, the upper inner wall of the inclined part 30*b*).

The common collection pipe 40 has the same shape as the common supply pipe 30. The common collection pipe 40 includes a tubular part 40*a* and an inclined part 40*b*. The inside of the tubular part 40*a* communicates with the inside of the inclined part 40*b*. A lower inner wall and an upper inner wall of the tubular part 40*a* are horizontal. The inclined part 40*b* is provided at the upper part of the tubular part 40*a* and at the center in the width direction. The size of the inclined part 40*b* in the width direction is small as compared with the size of the tubular part 40*a* in the width direction. The flow path cross section of the inclined part 40*b* is semicircular. The inclined part 40*b* has a linear positive inclination from the first end side to the second end side with respect to the horizontal direction. Accordingly, the flow path cross-sectional area of the inclined part 40*b* becomes large from the first end side to the second end side. The upper surface of a discharge port 403 is provided at the second end side of the common collection pipe 40 and in the vicinity of the inner wall of the inclined part 40*b* (so as to contact with, for example, the upper inner wall of the inclined part 40*b*).

In the common supply pipe 30 and the common collection pipe 40 shown in FIG. 4, since the change of the flow path cross-sectional area in the longitudinal direction is small, speed change of ink flowing through the inside is small. Thus, a difference between pressures applied to the respective inkjet heads 101*a* to 101*e* becomes small.

Figure 5:
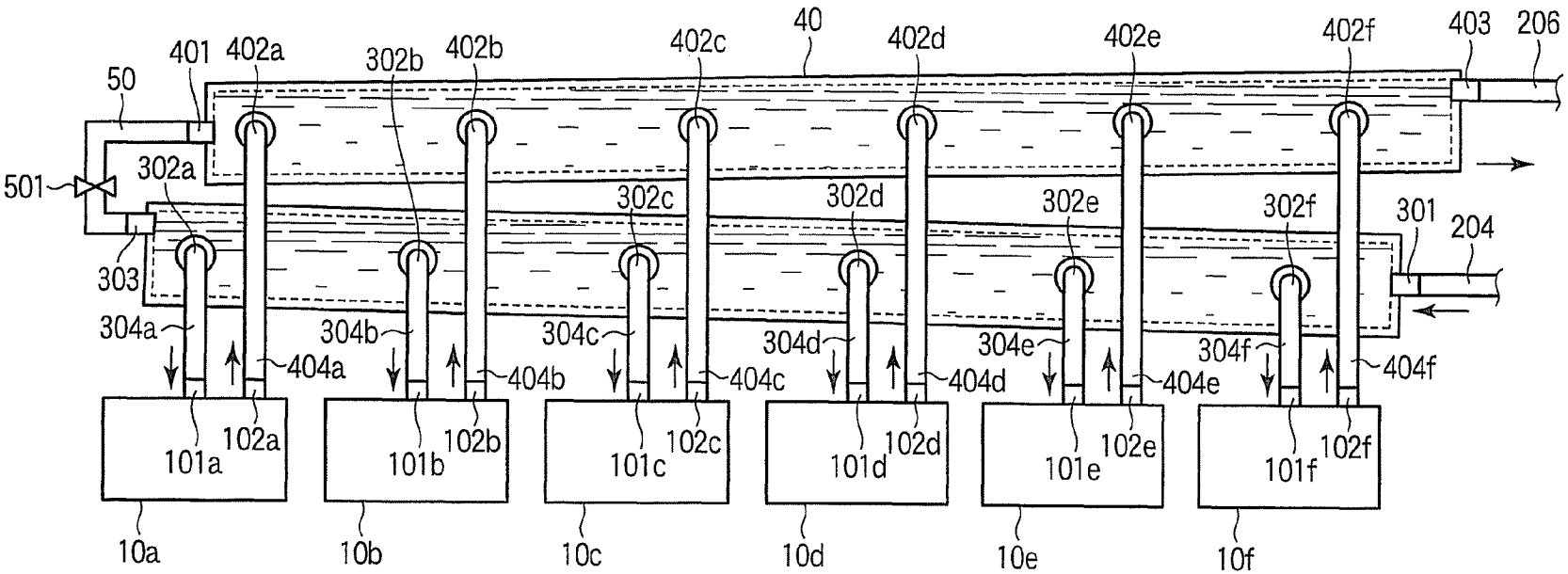
FIG. 5 is an exemplary view showing the common supply pipe and the common collection pipe of the embodiment.

FIG. 5 is a lateral direction sectional view of an inkjet recording apparatus 1 showing another example of a common supply pipe 30 and a common collection pipe 40. The common supply pipe 30 has the same shape as the common collection pipe 40. The common supply pipe 30 has a tubular shape in which a flow path cross-sectional area is uniform in a longitudinal direction. The common supply pipe 30 is obliquely provided in the inkjet recording apparatus 1 so that a position at a second end side becomes higher than a position at a first end side. Accordingly, an upper inner wall of the common supply pipe 30 has a positive inclination from the first end side to the second end side with respect to the horizontal direction. Similarly, the common collection pipe 40 has a tubular shape in which a flow path cross-sectional area is uniform in the longitudinal direction. The common collection pipe 40 is obliquely provided in the inkjet recording apparatus 1 so that a position at a second end side becomes higher than a position at a first end side. Accordingly, an upper inner wall of the common collection pipe 40 has a positive inclination from the first end side to the second end side with respect to the horizontal direction.

Figure 6:
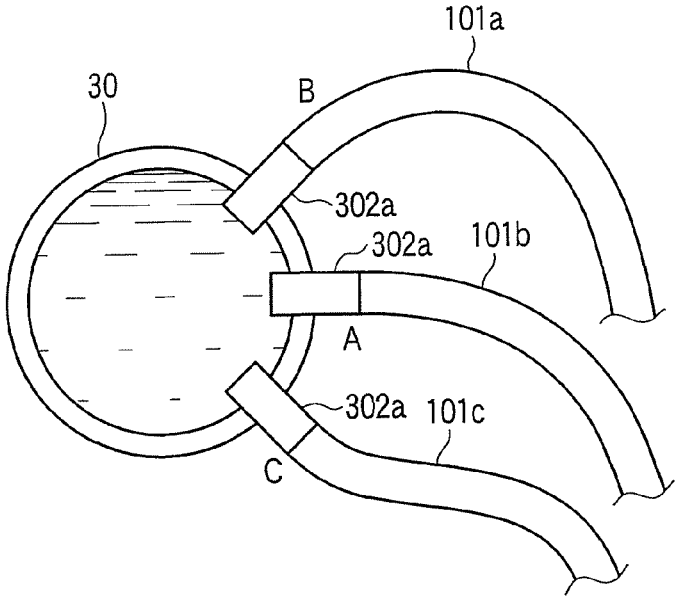
FIG. 6 is an exemplary view showing connection between the common supply pipe and a head supply pipe of the embodiment.

FIG. 6 is a flow path sectional view showing connection between the common supply pipe 30 and the head supply pipe 304*a*. The head supply pipe 304*a* shown at position A is provided so that its center axis coincides with the horizontal line passing through the center of the flow path cross section of the common supply pipe 30. That is, the front end of the head supply pipe 304*a* is connected to the common supply pipe 30 in a direction orthogonal to the horizontal direction. The head supply pipe 304*a* shown at position B is provided so that the front end thereof is directed downward to the center of the flow path cross section of the common supply pipe 30. In this case, there is a possibility that air bubbles staying in the inside of the common supply pipe 30 enter the inside of the head supply pipe 304*a* and stay. The head supply pipe 304*a* indicated at position C is provided so that the front end thereof is directed upward to the center of the flow path cross section of the common supply pipe 30. In this case, there is a possibility that foreign matters staying in the common supply pipe 30 precipitate in the inkjet head 101*a* through the head supply pipe 304*a*. Accordingly, it is preferable that the supply pipe 304*a* is provided to the common supply pipe 30 at the position A, not the positions B and C. Incidentally, the same applies to the relation between the common supply pipe 30 and each of the head supply pipes 304*b* to 304*f*. Further, the same applies to the relation between the common collection pipe 40 and each of the head collection pipes 404*a* to 404*f*.

Incidentally, the embodiment can also be applied to one line head which covers the sheet width and includes a plurality of supply ports and discharge ports. According to the embodiment, in the structure in which the flow path resistance at the branch ports 302*a* to 302*f* and the joining ports 402*a* to 402*f* is sufficiently reduced, the air in the inside of the common supply pipe 30 and the common collection pipe 40 can be satisfactorily discharged to the ink tank device 20 side. Further, according to the embodiment, since the inkjet recording apparatus 1 includes the connection pipe 50 having the valve 501, the ink can be certainly filled in the inside of the common supply pipe 30 and the common collection pipe 40.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An inkjet recording apparatus comprising:

a plurality of inkjet heads;

a common supply pipe which is connected to a plurality of head supply pipes to supply ink to the plurality of inkjet heads, and includes an upper inner wall from one end side in a longitudinal direction to the other end side, which is inclined with respect to a horizontal direction from the one end side to the other end side if an ink flow direction and opposite direction of a gravitational force are defines as positive axes;

a common collection pipe to which the ink is supplied from the common supply pipe at one end side in the longitudinal direction, and which includes a plurality of head collection pipes to collect the ink from the plurality of inkjet heads; and an ink tank device which supplies the ink to the one end side of the common supply pipe, and collects the ink from the common collection pipe.

2. The apparatus of claim 1, wherein a flow path cross-sectional area of the common supply pipe becomes large from the one end side to the other end side.

3. The apparatus of claim 1, wherein the common supply pipe includes a protruded inclined part along the longitudinal direction at a part of the upper inner wall.

4. The apparatus of claim 1, wherein the common supply pipe has a flow path cross-sectional area uniform along the longitudinal direction, and is inclined from the one end side to the other end side with respect to the horizontal direction.

5. The apparatus of claim 1, wherein the common supply pipe includes a discharge port of the ink at the other end side and in a vicinity of the upper inner wall.

6. The apparatus of claim 1, wherein a flow path cross-sectional area of the common supply pipe is larger than a flow path cross-sectional area of each of the plurality of head supply pipes.

7. The apparatus of claim 1, wherein each of the plurality of head supply pipes is connected to the common supply pipe in a direction orthogonal to the horizontal direction.

8. The apparatus of claim 1, wherein the common collection pipe includes, an upper inner wall inclined with respect to the horizontal direction in the positive direction from the one end side, at which the ink from the common collection pipe is supplied, to the other end side in the longitudinal direction.

9. The apparatus of claim 8, wherein a flow path cross-sectional area of the common collection pipe becomes large from the one end side to the other end side.

10. The apparatus of claim 8, wherein the common collection pipe includes a protruded inclined part along the longitudinal direction at a part of the upper inner wall.

11. The apparatus of claim 8, wherein the common collection pipe has a flow path cross section uniform along the longitudinal direction, and is inclined from the one end side to the other end side with respect to the horizontal direction.

12. The apparatus of claim 8, wherein the common collection pipe includes a discharge port of the ink at the other end side and in a vicinity of the upper inner wall.

13. The apparatus of claim 8, wherein a flow path cross-sectional area of the common collection pipe is larger than a flow path cross-sectional area of each of the plurality of head collection pipes.

14. The apparatus of claim 8, wherein the common collection pipe is arranged above the common supply pipe in a vertical direction.

15. The apparatus of claim 1, comprising a connection pipe which connects the other end side of the common supply pipe to the one end side of the common collection pipe.

16. The apparatus of claim 15, comprising an opening and closing valve which is provided in the connection pipe.

17. An inkjet recording apparatus comprising:

tubular common supply means connected to a plurality of head supply pipes for supplying ink to a plurality of inkjet heads, and including an upper inner wall from one end side in a longitudinal direction to the other end side, which is inclined with respect to a horizontal direction from the one end side to the other end side if an ink flow direction and opposite direction of a gravitational force are defines as positive axes;

tubular common collection means to which the ink is supplied from the common supply means at one end side in the longitudinal direction for collecting the ink from the plurality of inkjet heads; and ink tank means for supplying the ink through the one end side of the common supply means, and collecting the ink from the common collection means.

18. The apparatus of claim 17, wherein the common collection means includes, an upper inner wall inclined with respect to the horizontal direction in the positive direction from the one end side, at which the ink from the common supply means is supplied, to the other end side in the longitudinal direction.

19. The apparatus of claim 17, wherein a flow path cross-sectional area of the common supply means is larger than a flow path cross-sectional area of each of the plurality of head supply pipes.

* * * * *